US006827597B1

(12) United States Patent
Metzbower et al.

(10) Patent No.: US 6,827,597 B1
(45) Date of Patent: Dec. 7, 2004

(54) COMBINED ELECTRICAL AND OPTICAL CABLE CONNECTOR PARTICULARLY SUITED FOR MARINE SEISMIC SENSOR STREAMERS

(75) Inventors: D. Richard Metzbower, Austin, TX (US); Slawomir Bielinski, Austin, TX (US); Steven J. Maas, Austin, TX (US); Jeffrey J. Bowlus, Pfugrevill, TX (US); Andre Stenzel, Richmond, TX (US)

(73) Assignee: PGS Americas, Inc., Houston, TX (US)

( * ) Notice: Subject to any disclaimer, the term of this patent is extended or adjusted under 35 U.S.C. 154(b) by 0 days.

(21) Appl. No.: 10/717,821

(22) Filed: Nov. 20, 2003

(51) Int. Cl.[7] ..... H01R 12/62
(52) U.S. Cl. ..... 439/320; 439/475
(58) Field of Search ..... 439/320, 475, 439/903

(56) References Cited

U.S. PATENT DOCUMENTS

| | | | | |
|---|---|---|---|---|
| 2,866,957 | A | * 12/1958 | Raypholtz | 439/246 |
| 2,962,688 | A | * 11/1960 | Werner | 439/320 |
| 3,323,096 | A | * 5/1967 | Appleton | 439/320 |
| 4,648,083 | A | 3/1987 | Giallorenzi | |
| 4,690,487 | A | 9/1987 | Hale et al. | |
| 4,733,935 | A | 3/1988 | Gandy | |
| 4,756,595 | A | 7/1988 | Braun et al. | |
| 4,848,906 | A | 7/1989 | Layton | |
| 4,887,883 | A | 12/1989 | Darbut et al. | |
| 4,913,514 | A | 4/1990 | Then | |
| 4,953,944 | A | 9/1990 | Moulin | |
| 5,062,682 | A | 11/1991 | Marazzi | |
| 5,064,268 | A | 11/1991 | Morency et al. | |
| 5,125,056 | A | 6/1992 | Hughes et al. | |
| 5,283,848 | A | 2/1994 | Abendschein et al. | |
| 5,448,676 | A | 9/1995 | White et al. | |
| 5,461,688 | A | 10/1995 | Lee | |
| 5,590,229 | A | 12/1996 | Goldman et al. | |
| 5,636,310 | A | 6/1997 | Walles | |
| 6,084,233 | A | 7/2000 | Hodgson et al. | |
| 6,217,229 | B1 | 4/2001 | Arab-Sadeghabadi et al. | |
| 6,394,661 | B1 | 5/2002 | Cull et al. | |
| 6,434,316 | B1 | 8/2002 | Grois et al. | |

* cited by examiner

*Primary Examiner*—Phuong Dinh
(74) *Attorney, Agent, or Firm*—Richard A. Fagin; E. Eugene Thigpen

(57) ABSTRACT

A connector is disclosed for joining two cable ends. The connector includes a load transfer plug adapted to couple to a strength member in each end of the cable. A connector insert assembly is coupled to an inner portion of each load transfer plug. Conductor terminals are disposed in corresponding openings of the insert. The terminals protrude from the insert. An alignment sleeve holder is coupled to one of the insert assemblies. The alignment sleeve holder includes alignment sleeves for receiving the protruding terminals. A housing element is sealingly coupled to an exterior of each of the plugs. The housing elements are adapted to coupled to each other and to urge the connector insert assemblies into contact with each other, and to transfer axial load between the plug coupled to each end of the cable. The housing elements have rotational and axial alignment features on corresponding surfaces. The housing elements are adapted to be removed from the plugs without uncoupling the cable from the plug.

41 Claims, 6 Drawing Sheets

COMBINED ELECTRICAL AND OPTICAL CABLE CONNECTOR PARTICULARLY SUITED FOR MARINE SEISMIC SENSOR STREAMERS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of connectors for electrical and fiber optic cables. More specifically, the invention relates to connectors used with combined electrical/fiber optic cables such as those used in marine seismic sensor systems, among other applications.

2. Background Art

Fiber optic and combination fiber optic/electrical conductor cables are well known in the art. Such cables include one or more electrical conductors for carrying electrical power and electrical signals, and one or more optical fibers that carry optical signals and/or light from a source such as a laser diode. It is known in the art to use combination fiber optic/electrical cables for marine seismic survey systems. Marine seismic survey systems include a plurality of seismic sensors disposed at spaced apart locations along a cable known as a "streamer." One or more of such streamers are towed behind a seismic survey vessel in the water. The streamer cable may include one or more optical fibers to carry signals generated by the sensors in response to seismic energy up to recording equipment on the seismic vessel. The streamer may use the one or more electrical conductors to carry electrical power to various signal amplification and processing devices within the streamer. Fiber optic/electrical cables used in marine seismic sensor systems also include some form of "strength member", such as a wire rope, steel cable or conventional organic rope to support axial loads as the cable is towed through a body of water. Marine seismic sensor optical/electrical cables also typically include some form of fluid tight sheath or "jacket" on the exterior surface to exclude water and other fluids from entering the body of the cable. In some cases, the jacket may be filled with oil of other material that is water resistant and electrically non-conductive.

It is also known in the art to use fiber optic sensors, rather than electrical sensors, for the seismic sensors in a marine seismic streamer. Typically, a number of streamers will be towed in a selected pattern by a seismic vessel and the seismic sensors will be arranged at selected spaced apart positions along each streamer for form a sensor arrangement referred to as an "array." Fiber optic sensor arrays have been disclosed in a number of publications, among them being U.S. Pat. No. 4,648,083 issued to Giallorenzi and entitled, All-Optical Towed and Conformal Arrays, U.S. Pat. No. 4,848,906 issued to Layton entitled, Multiplexed Fiber Optic Sensor and more recently, U.S. Pat. No. 6,084,233 issued to Hodgson et al. entitled, Optical Sensor Array Having Multiple Rungs Between Distribution and Return Buses and Having Amplifiers in the Buses to Equalize Return Signals.

As a practical matter, in order to effectively deploy, transport and store the sensor arrays, it is necessary to be able to easily, reliably and quickly couple and uncouple various components of the array. Thus, it is frequently necessary to couple and uncouple segments of combination fiber optic/electrical cables when such cables are used in the array. Connector assemblies to transmit optical signals from one length of fiber optic cable to another are well known in the art. Additionally, connectors are also known in the art which simultaneously make a number of optical and/or electrical connections via a connector housing containing multiple cavities which locate optical and/or electrical terminals. A system and method for precisely and simultaneously making multiple fiber optic connections for hydrophone arrays is disclosed, for example, in U.S. Pat. No. 5,590,229 issued Goldman et al. entitled, Multichannel Fiber Optic Connector, and in U.S. Pat. No. 6,217,229 issued to Arab-Sageghabadi et al. entitled, Fiber Optic Connector with Dowel Alignment of Mating Members. Numerous United States Military specifications also describe multicavity connectors and fiber optic terminals, including MIL-C-38999, MIL-C-5015 and MIL-T-29504, among others. Telecommunications industry specifications such as GR-326-CORE, Generic Requirements for Single-mode Optical Connectors and Jumper Assemblies, published by Telcordia Technologies, Inc. Piscataway, N.J. 08854, also describe the requirements and features of a series of 1.25 millimeter form factor single and dual terminal optical fiber connectors.

The use of optical fiber in sensor arrays can offer distinct advantages over electrical sensor arrays. In general, optical fiber is able to carry a greater quantity of data over a longer distance than electrical wire. This ability may eliminate or reduce the need for electronics to be located out in the environment away from the seismic vessel or a data receiving station. Additionally, optical fiber is lighter and smaller than the electrical wires necessary to carry an equivalent number of signals. There is also no possibility to develop an electrical short circuit to the seawater environment.

To successfully manage a seismic sensor system it is frequently necessary to divide the array into sections. For example, in a seismic streamer system the system may be divided up into the receiving electronics, shipboard cabling, lead-in or towing cable, and multiple sensor sections. Each of these parts of the system needs to be electrically and/or optically connected to other parts of the system. At each connection between system components, some type of reusable connector is needed to transfer signals and mechanical load across the connection and provide protection of the signal carrying devices from the surrounding environment. The signals may either be electrical or optical, or both. The mechanical loads may be tension, torsion, or bending moment. The environmental protection required may be from fluid pressure, contamination, crush, and shock among others.

As the size and complexity of seismic sensor arrays increases, the number of optical and electrical connections that must be made by the various connectors between system components can increase as well. As the mating connector assemblies are brought together and engaged, the connector simultaneously connects multiple optical terminals. Each optical terminal couples a corresponding end of one optical fiber. Precise alignment of the optical terminals across the connector is necessary for proper optical energy transfer. Proper optical energy transfer is typically defined by the transmitting of optical signals between corresponding optical terminals with a minimum of optical power loss and optical signal back-reflection. Connectors known in the art typically provide optical power loss across the coupling of approximately 0.3 dB maximum and 0.2 dB or less average. Back signal reflection for connectors known in the art typically greater than 40 dB below the transmitted signal.

Precise alignment in connectors known in the art is obtained by allowing the optical terminals to "float" in a cavity within an insert located in the connector assembly. As the mating terminals as are brought together, they are engaged by an alignment sleeve which, cooperating with the "float" clearance in the cavity, aligns the terminal axes. To achieve the needed degree of axial alignment of the optical terminals the insert must also be located precisely inside a mechanical housing in both the axial and radial directions. Additionally, a high degree of precision is required to mate the corresponding housings in the axial and radial directions. As a result, very close tolerances are required in the manufacture of components of the typical optical cable connector.

There are further considerations that also affect the cost, complexity and degree of reparability of all optical or electro-optical connector assemblies. One of the considerations is the number of unique parts required to make and assemble the two different genders of the connector assembly. The components of optical cable connectors known in the art are typically completely, or nearly completely, different for male and female parts of the connector. Another consideration is that optical cable connectors known in the art typically do not have a self contained optical service loop. Consequently, when an optical terminal in the connector becomes faulty a total removal and reinstallation of the connector assembly is required, rather than a much simpler and cost effective replacement of the damaged terminal alone. Also, in cases where an electromechanical connector assembly has been converted to either opto-mechanical or electro-opto-mechanical the housing normally provides the backbone for the connector assemblies. This frequently necessitates the near complete disassembly of the connector assembly to access the connector insert. Also, converted connector assemblies do not do a good job of managing optical fiber so as to prevent microbends and kinks.

There is thus a need for a optical cable connector or a combined electrical-optical cable connector that facilitates repairs, reduces the number of gender-specific connector components, and is less expensive to produce and maintain.

SUMMARY OF THE INVENTION

One aspect of the invention is a connector for joining two cable ends. The connector includes a load transfer plug adapted to couple to a strength member in the cable. A connector insert assembly is coupled to an inner portion of each load transfer plug. Conductor terminals are disposed in corresponding openings of the connector insert assembly. The terminals protrude from the connector insert assembly. An alignment sleeve holder is coupled to one of the connector insert assemblies. The alignment sleeve holder includes alignment sleeves therein for receiving the protruding terminals. A housing element is coupled to an exterior of each of the load transfer plugs. The housing elements are adapted to coupled to each other and to urge the connector insert assemblies into contact with each other and to transfer axial load between the load transfer plugs coupled to each end of the cable. The housing elements have rotational and axial alignment features on corresponding surfaces thereof. The housing elements are also adapted to be removed from the load transfer plugs without uncoupling the cable from the load transfer plug.

Other aspects and advantages of the invention will be apparent from the following description and the appended claims.

DETAILED DESCRIPTION

Figure 1:
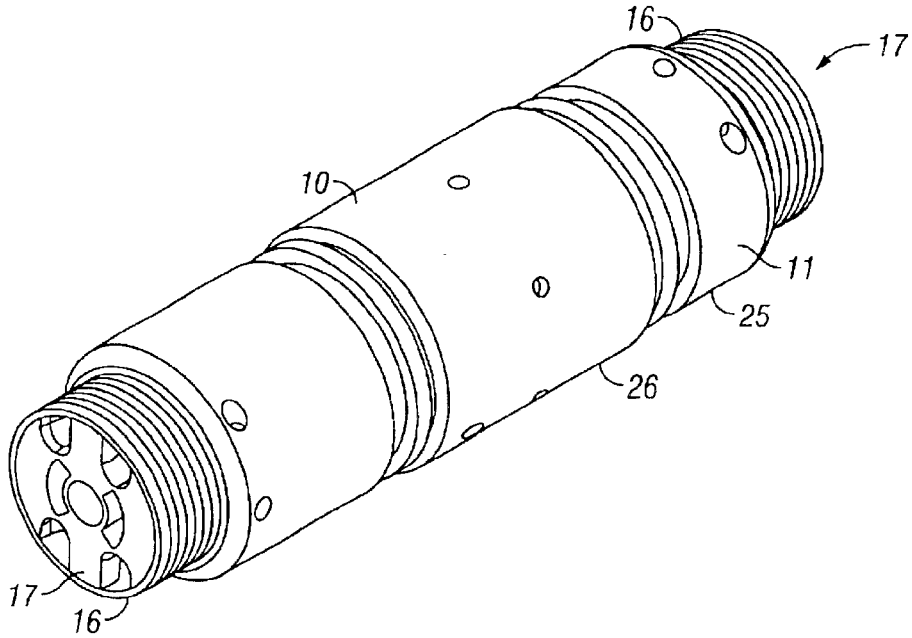
FIG. 1 shows mated male and female members of one embodiment of a connector assembly according to the invention.

Embodiments of a cable connector according to the present invention may be used with both fiber optic cable and with combination fiber optic/electrical conductor cable. Accordingly, it is to be clearly understood that the invention is not limited in scope to use with fiber-only or combination fiber/electric cables. In FIG. 1 female and male members, 10 and 11 respectively, of one embodiment of a connector according to the invention, are shown mated to provide an approximate appearance of the connector when mated or "made-up." The members 10, 11 in this embodiment are coupled by correspondingly threaded housings. A male housing is shown at 25, and the corresponding female housing is shown at 26 in FIG. 1. The connector members 10, 11 are each affixed to an end of a fiber optic or combination fiber optic cable (not shown in FIG. 1) by a load transfer assembly consisting of a hose termination ring 16 and a load transfer plug 17. The load transfer assembly components and connection to the cable ends will be further explained below with respect to FIG. 9.

Figure 2:
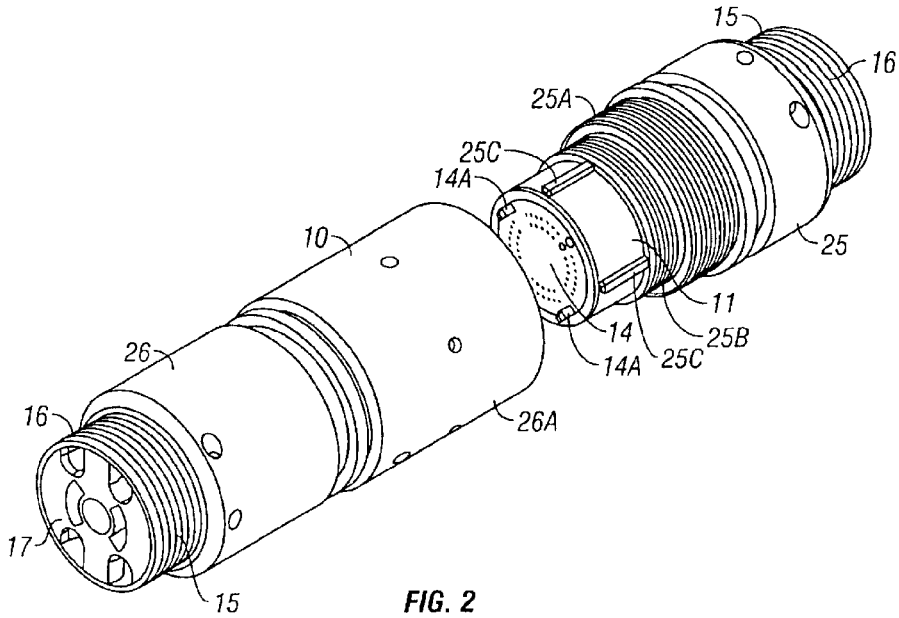
FIG. 2 shows the male and female members of the embodiment of FIGS. 1A and 1B in an unmated state.

FIG. 2 shows the two members 10, 11 of the exemplary embodiment of the connector uncoupled to show some of the inner details, particularly of the male member 11. Electrical and optical coupling components (not shown in FIG. 2) of the male member 11 are enclosed and protected by the male housing 25. The male housing 25 is generally cylindrical in form and covers at one end the load transfer plug (17 in FIG. 1). The male housing 25 contains features (e.g. grooves 25B) for sealing to the female housing 26, such as by means of elastomeric O-rings (not shown in FIG. 2) or the like, against a corresponding inner sealing surface on the female housing 26 when the two housings 25, 26 are mated. The embodiment of the connector shown in FIG. 2 includes external threads 25A of types well known in the art for mechanically coupling the male housing 25 to corresponding internal threads (not shown) in a coupling sleeve 26A forming part of the female housing 26. Thus, the embodiment of the connector members shown in FIG. 2 are mated by threading the female member housing sleeve 26A onto the threads 25A in the male housing 25. While the male 25 and female 26 housings are shown as coupled to each other by means of corresponding threads, it should be clearly understood that other forms of coupling could be used, including, for example corresponding pin and slot connections, or one or more apertures formed in the exterior surface of the female housing 26 through which pins may be inserted to lock to a corresponding groove, slot or aperture in the exterior surface of the male housing 25.

Also forming part of or coupled to the male housing 25 are features that allow for the keying of the connector assembly, To achieve this single or multiple alignment keys may be used. The figure shows the use of multiple alignment keys 25C on the exterior surface thereof for aligning the housings 25, 26 to each other axially and rotationally upon make-up. An end face of a male connector insert assembly 14 is shown on the front face of the male member 11. Multiple keys 14A for aligning the insert assembly 14 with its corresponding female insert assembly (not shown in FIG. 2) in the female member 10 protrude from the face of the male connector insert assembly 14. Both the female 26, and male 25 housings should include features (not shown in FIG. 2) for sealing their respective interior surfaces against the mating exterior surface of the corresponding load transfer plug 17 so as to form a fluid tight seal between each housing 25, 26 and the corresponding one of the load transfer plugs 17.

Each connector member 10, 11 includes a load transfer assembly 15, which is disposed at the outer end of each of the members 10 and 11. The load transfer assemblies 15 each mechanically couple to a fiber optic or combination fiber optic/electrical cable (not shown in FIG. 2), and transfer axial load from the cable (not shown) to the connector member (10, 11). Each load transfer assembly 15 includes the previously described hose terminator ring 16 and load transfer assembly plug 17. The functions and relevant features of the hose terminator ring 16 and the plug 17 will be further explained below with reference to FIG. 9.

Figure 1A:
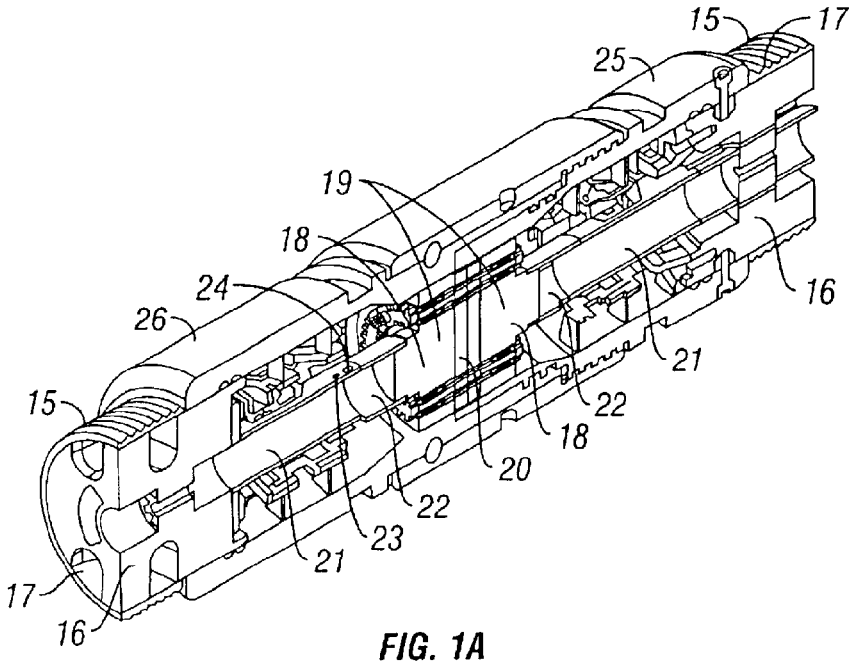
FIG. 1A is a section view of the male and female members of the connector shown in FIG. 1.
Figure 1B:
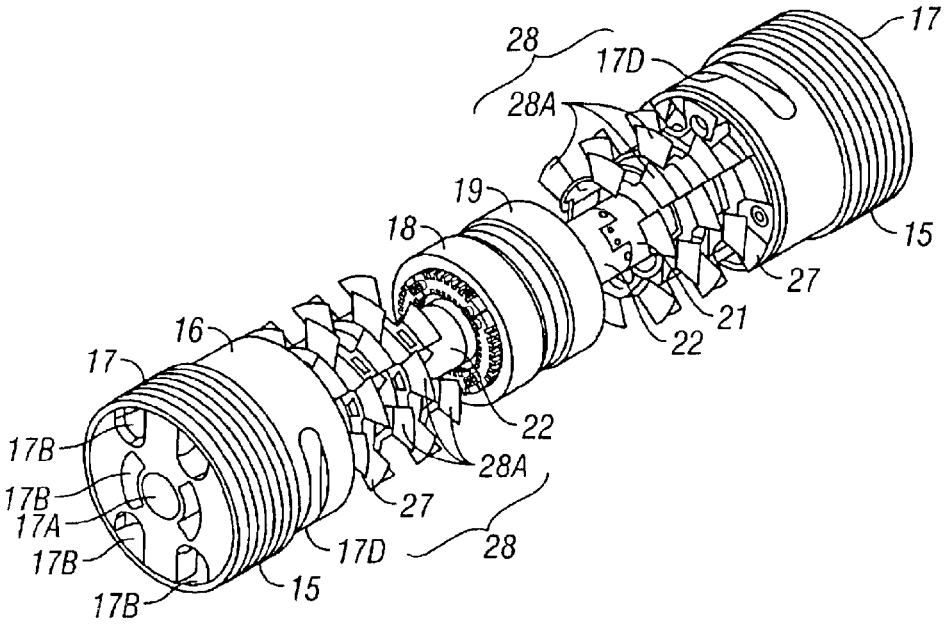
FIG. 1B is a view of the mated male and female members of the connector assembly of FIG. 1 with housings removed to show internal parts and assemblies.

FIGS. 1A and 1B show the interior structure of the connector assembly in more detail. FIG. 1A is a section view of the mated connector assembly. FIG. 1B shows the male and female members, designated 10 and 11 respectively, with their respective housings 25, 26 absent from the drawing to show greater detail. FIG. 1B shows in detail mated connector inserts 18, 19 disposed in the middle of the assembles connector members (10, 11). A male connector insert 18 is mated to a corresponding female connector insert 19. The female connector insert 19 generally includes two subassemblies, one being the equivalent component to the male insert 18 and an alignment sleeve holder 20 coupled to the front face of the insert 19. One of the benefits of the connector insert configuration shown in FIG. 1B is that the main bodies of both the female and male connector inserts can include the same type of male connector insert, i.e. insert 18. With the use of the same type of male connector insert within the main body of the both the female connector insert assembly 19 and the male insert assembly 18, the mounting of the insert assemblies becomes substantially identical for both male 18 and female 19 connector insert assemblies.

Referring to FIG. 1A, mechanical support for the connector inserts 18, 19 to the corresponding one of the load transfer plugs 17 is provided by the following mounting structure. The mounting structure for both of the inserts 18, 19 each includes a standoff 21 and a potting cup 22. The standoff 21 is attached to the load transfer assembly plug 17 by a plurality of fasteners, preferably cap screws (not shown), and is rotationally keyed to the load transfer assembly plug 17 by a uniquely located integral pin. A mounting hole for the standoff keying pin is located in the load transfer assembly plug 17 relative to slots (17D in FIG. 1B) in the plug 17 for locating shear pins (29 in FIGS. 3 and 4). The shear pins will be explained below with reference to FIG. 3.

Still referring to FIG. 1A, the potting cup 22 is attached to the standoff 21 by a series of spring pins 24. The spring pins 24 are located within the standoff 21 using tight fit holes, and within the potting cup using loose fit slots (22A in FIG. 1B). This looseness of fit between the potting cup 22 and the spring pins 24 allows for movement of the potting cup 22 relative to the standoff 21. A spring 23 is located between the standoff 21 and the potting cup 22. The combination of the spring 23 and the loose fit slots 22A enables some axial and lateral movement of the potting cup 22, and consequently the male connector insert assembly 18 (and the female connector insert assembly 19 in the female member 11), with respect to the respective load transfer assembly plug 17. This provision for axial and lateral movement, or "float", of the insert assemblies 18 and 19 addresses one of the principal issues with the state of the art by simplifying the design and construction of the standoff 21, potting cup 22, the male housing 25 and the female housing 26 by reducing the degree of precision required to achieve the desired alignment of optical terminals (which will be further explained). Additionally, in some embodiments unequal angular spacing of the hole pattern for locating the spring pins 24 may be used to provide a unique angular position, and therefore rotational keying of the potting cup 22 to the standoff 21.

FIG. 1B shows a plurality of feed-thru holes 17A, 17B in the load transfer plug 17, specifically shown on the plug in the female member 10. These feed-thru holes 17A, 17B serve for both pass-through and sealing of the optical fibers and electrical wires (both not shown for clarity) within the cable (not shown). During assembly of a connector member (either male or female) to the cable (not shown), the optical fibers can be fed thru the smaller holes 17B, and sealing compound such as epoxy can be applied between the fibers and the holes on the side of the load transfer plug 17 facing away from the male insert body 18. The connector insert may also be designed to use another type of sealing mechanism, such as gland seals, without changing the design intent of the connector assembly. In a like fashion the electrical wires can be fed thru the larger hole 17A near the center of the load transfer assembly plug 17 and epoxy, or other sealing mechanism, can then be applied between the wires and the plug In FIG. 1B attached to the inside faces of the load transfer assembly 15 are a plurality of conductor storage reels 28. The reels 28 can be formed by first attaching a reel base 27 to the load transfer assembly plug 17. With the reel base 27 fixed to the plug 17 one or more reel segments 28A can be added to form the desired number of reel sections. The reel segments 28A can be configured to snap into the reel base 27 and into each other to form a selected number of reel sections, depending on the length of optical fiber that is desired to be stored within each connector member (10, 11 in FIG. 1). In some embodiments, the reel diameter and/or configuration is selected such that optical fibers wound thereon maintain a selected minimum radius of curvature. Typically, the minimum radius of curvature is selected such that substantially no optical signal loss is introduced by reason of excessive bending of the optical fiber. The storage reels also reduce the possibility of the optical fibers undergoing microbends or kinks.

Advantageously, having conductor storage reels 28 provides a device for storing a substantial length of optical fibers and/or electrical conductors from the cable (not shown). Storing optical fibers and/or electrical conductors provides a connector member according to the invention with the capacity to be repaired a number of times by replacing optical terminals and/or electrical terminals on the fiber or conductor ends, without the need to detach the cable strength member (not shown) or jacket (not shown) from the load transfer assembly. This may provide the advantage of longer cable life and reduced cost to repair a cable connector. As may be readily inferred by reference to FIG. 1B, the reels 28 should be affixed to the plug 17 before coupling the standoff 21, potting cup 22 and respective insert (18 or 19).

Figure 3:
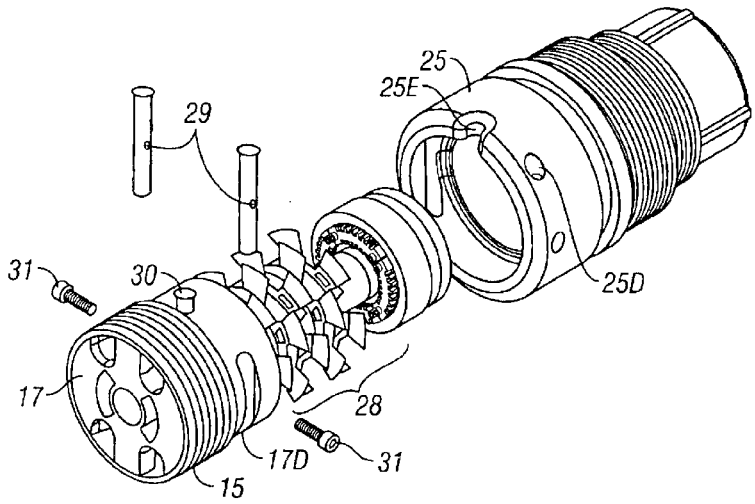
FIG. 3 is an exploded view of the embodiment of FIGS. 1A and 1B showing the male member with shear pin locating screws removed, allowing the shear pins to be retracted and thus enabling the housing to be removed.

FIG. 3 shows the manner of assembly and attachment of the male housing 25 onto the corresponding load transfer assembly 15 of the male member 10. Shear pins 29 are inserted through holes 25D in the housing 25 and into corresponding slots 17D in the load transfer assembly plug 17. The shear pins 29 transfer mechanical loads between the housing 25 and the load transfer assembly plug 17. The mechanical loads may be torque, bending moment or tension. The shear pins 29 may be held in place by set screws 31 that are inserted through the housing 25 and thread into corresponding openings in the shear pins 29. The housing 25 is rotationally keyed to the load transfer assembly 15 using a slot 25E corresponding to the rotational position of a dowel pin 30 that can be pressed into the load transfer assembly plug 17. Consequently, the male housing 25 can be removed from the load transfer assembly 15 by removal of the shear pins 29. This ability to remove the housing 25 without further disassembly of the male member 10, facilitates repair and rework, lowering the operational costs of the connector. Further, installation of the male housing 25 after complete assembly of the other internal components insures that the fibers and electro-optic insert are completely and securely held in place, thus reducing the possibility of optical fiber microbends and/or kinks, both of which result in excessive signal loss along the optical fiber.

The shear pins 29 may be selected to fail at a load amount which is smaller than the axial load bearing capacity of the threads (25A in FIG. 2) in the housings 25, 26, and more particularly, the axial load bearing capacity of the cable (not shown). In the event an axial load which might cause thread or cable failure is applied to the connector, the shear pins 29 on either the male 10 or female 10 member may fail, causing the corresponding housing 25, 26 to be axially uncoupled from its associated load transfer plug 17. The connector members 10, 11 can then separate without causing any damage to the structural components of the connector. Further, because the entry points of the cable conductors (not shown in FIG. 3) have been sealed as explained above, none of the internal components of the connector members such as the support assemblies (21 in FIG. 1B), potting cups (22 in FIG. 1B) and reels 28 will be exposed to fluid in the outside environment. As previously explained with respect to FIG. 1B, a substantial length of the fiber and/or electrical conductors (not shown) may be stored on the reels 28, thus allowing complete repairability of the separated connector members without the need to remove the cable (not shown) from the load transfer assembly 15.

Figure 4:
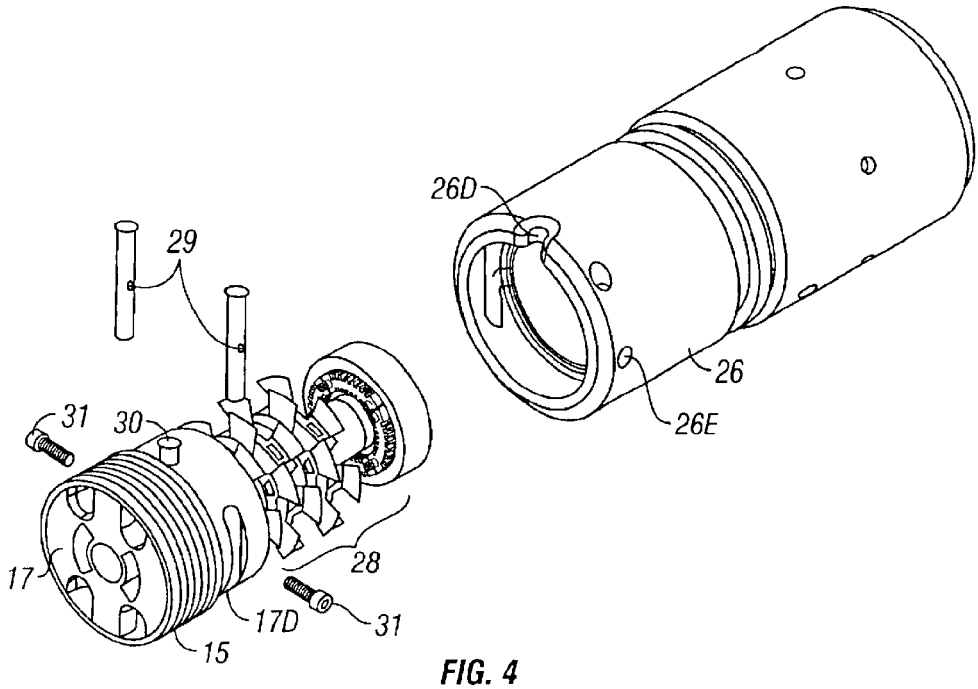
FIG. 4 is an exploded view of the embodiment of FIGS. 1A and 1B showing the female male member with shear pin locating screws removed, allowing the shear pins to be retracted and thus allowing the housing to be removed.

FIG. 4 shows the manner of assembly and attachment of the female housing 26 onto the load transfer assembly 15 of the female member 11. As with the male housing described above with respect to FIG. 3, shear pins 29 are inserted through holes 26E in the female housing 26 and into corresponding slots 17D the load transfer assembly plug 17. The shear pins 29 similarly transfer mechanical loads between the female housing 26 and the load transfer assembly plug 17. The mechanical loads may by torque, bending moment, or tension, just as is the case for the male member (10 in FIG. 1). The shear pins 29 are held in place by screws 31 that are inserted through openings in the female housing 26 and thread into the shear pins 29. The housing 26 may be rotationally keyed to the load transfer assembly plug 17 via a dowel pin 30 that is pressed into the load transfer assembly plug 17 and indexes with a corresponding slot 26D in the housing 26. As with the male housing 25 mentioned above, the female housing 26 can be removed from the load transfer assembly 15 by removal of the shear pins 29. Again, this ability to remove the female housing 26 without further disassembly of the male member 10 facilitates repair and rework, lowering the operational costs of the connector. Further, installation of the female housing 26 after complete assembly of the other internal components insures that the fibers and electro-optic insert are completely and securely held in place, thus reducing the possibility of optical fiber microbends and kinks.

Advantageously, load transfer assembly plugs, male housings and female housings made as shown in FIGS. 3 and 4, and as described above with respect to FIGS. 3 and 4 may be assembled so as to form either a male or female connector member. The female and male housings are interchangeably mountable on such identically formed load transfer assembly plugs 17. As will be explained below with respect to FIGS. 5 and 6, it is thus possible, in a connector made according to the present invention, to convert a male member to a female member, and vice versa.

Figure 5:
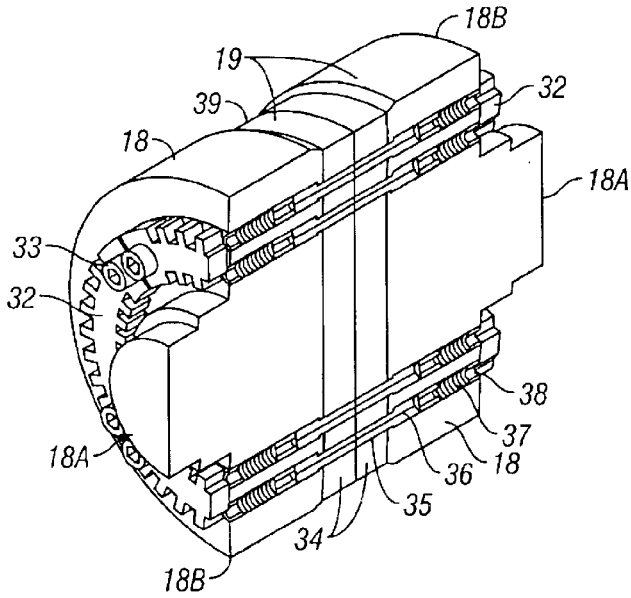
FIG. 5 is a section view of mated insert assemblies of the embodiment of FIGS. 1A and 1B.

FIG. 5 shows mated male and female connector insert assemblies 18 and 19. FIG. 5 shows optical fiber terminals 36 which are located in corresponding cavities in the male insert bodies 18B. A spring 37 acts on each one of the terminals 36 to exert an axial force that is necessary for proper operation of the terminals 36. For typical optical terminals, such as those known by industry designation "LC", the force is about 1.5 pounds. A spacer 38 reacts against the springs 37 and transfers the spring force to a retainer plate 32 coupled to the far end of each insert body 18B. Multiple retainer plates 32 may be used in some embodiments to allow for convenient grouping of the optical and/or electrical connections and ease of assembly. Screws 33 attach the retainer plates 32 to the back of the connector insert bodies 18B. Also shown in FIG. 5 is an alignment sleeve holder 39 which can be made from two alignment sleeve holder bodies 34 and alignment sleeves 35. The alignment sleeve holder 39 will be explained below with reference to FIG. 7. The connector insert bodies 18B each have a protrusion 18A adapted to be received in the corresponding potting cup (22 in FIG. 1B).

The arrangement of connector insert bodies 18B, terminals 36, springs 37, spacers 38 and retainer plates 32 provides that the axial force applied between corresponding terminals in each of the male and female connector members is not related to the axial force with which the male and female members are joined to each other. Once the connector insert assemblies are brought into contact with each other, coupling force between corresponding terminals 36 is controlled only by the force of the springs 37 which urge each terminal 36. Thus, a connector according to this embodiment of the invention is relatively insensitive to variations in coupling force between the connector members and is relatively insensitive to axial strain caused by tension applied to the cable (not shown) during use. A connector made according to the present embodiment thus can maintain substantially optimum contact force between terminals under a wide range of axial loading conditions on the connector.

Figure 6:
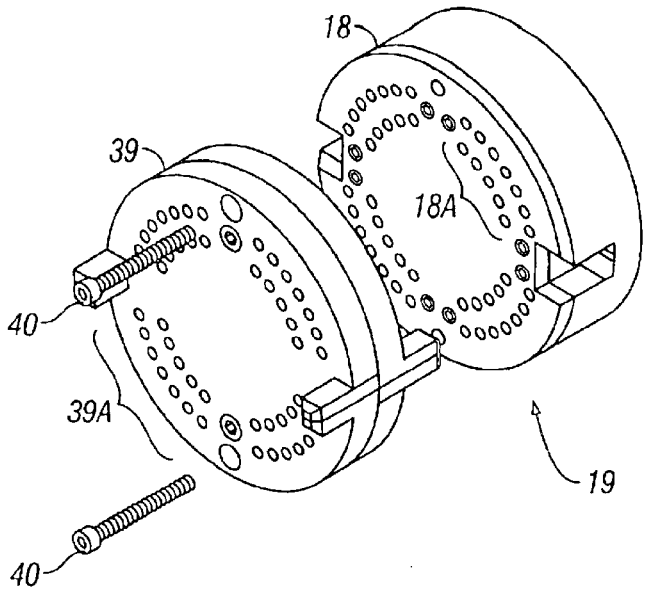
FIG. 6 is an exploded view of the embodiment of FIGS. 1A and 1B of the female insert assembly with an alignment sleeve holder and attaching screws removed from an hermaphroditic insert body.

FIG. 6 is an exploded view of the female connector assembly 19. The main body, shown at 18, of the female connector insert assembly 19, as previously explained, is equivalent to and substantially identical in structure to the male connector assembly 18. The male part of the connector insert assembly in both male and female versions contains the cavities that locate the fiber optic terminals (36 in FIG. 5). By using the same form of connector insert assembly in both the female and male connector insert assemblies, the number of different parts used is reduced and fabrication of the connector is simplified. To change the gender of a male connector insert assembly to a female connector insert assembly 19 an alignment sleeve holder 39 is attached to the front of the insert assembly 18. Two or more screws40, or other attachment mechanism (cap screws are shown), may be used to attach the alignment sleeve holder 39 to the male portion of the insert assembly 18. Cavities 39A on the alignment sleeve holder 39 correspond to the terminal cavities 18A on the male insert assembly 18.

Figure 7:
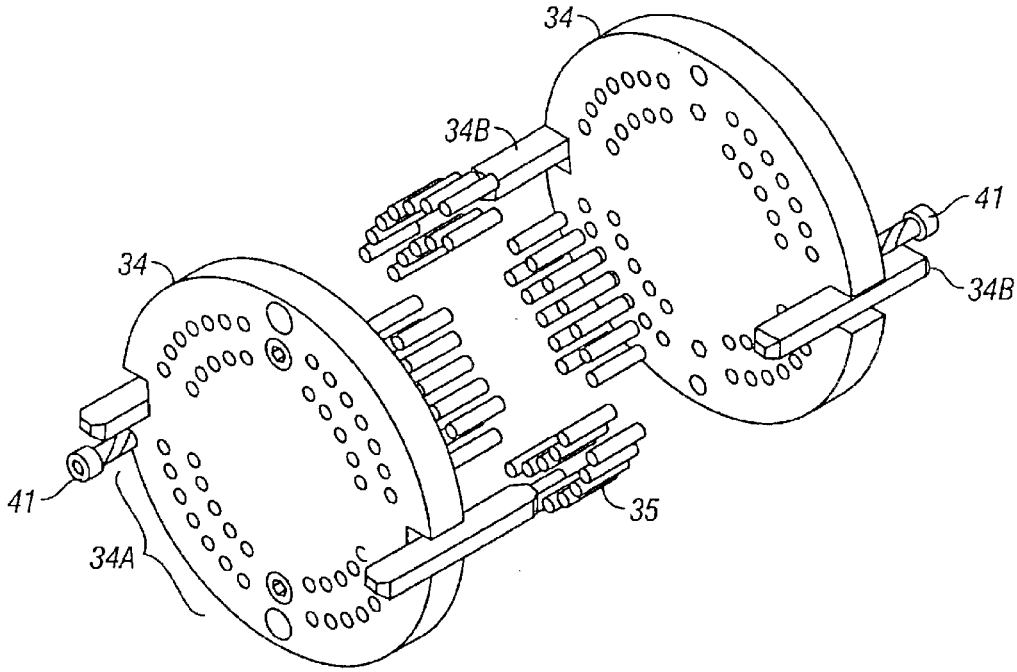
FIG. 7 is an exploded view of the embodiment of FIGS. 1A and 1B of the alignment sleeve holder showing the body halves, attaching screws, and entrapped alignment sleeves.

FIG. 7 is an exploded view of the alignment sleeve holder 39. Two substantially identical alignment sleeve holder bodies 34 are attached so that one of the bodies 34 is attached correspondingly to the other body 34 create cavities 3A to hold and locate alignment sleeves 35. Two screws 41 may be used to hold the two bodies 34 together. When the sleeve holder bodies 34 are attached together, the cavities 34A thus formed include a lip (not shown) on each axial end to fully capture the alignment sleeves 35. Also, when the alignment sleeve bodies 34 are mated, the female connector assembly alignment keys 34B are formed. These keys 34B protrude axially from both sides of the assembled bodies 34. On one side they engage the male connector insert assembly 18 for the purpose of correctly aligning the cavities 34A when attaching to the male portion of the connector insert assembly to ultimately form the female connector insert assembly 19. The part of the keys 34B that protrude axially from the other face of the assembled bodies 34 engage the male connector insert assembly 18 when the male and female members 10 and 11 are mated.

Figure 8:
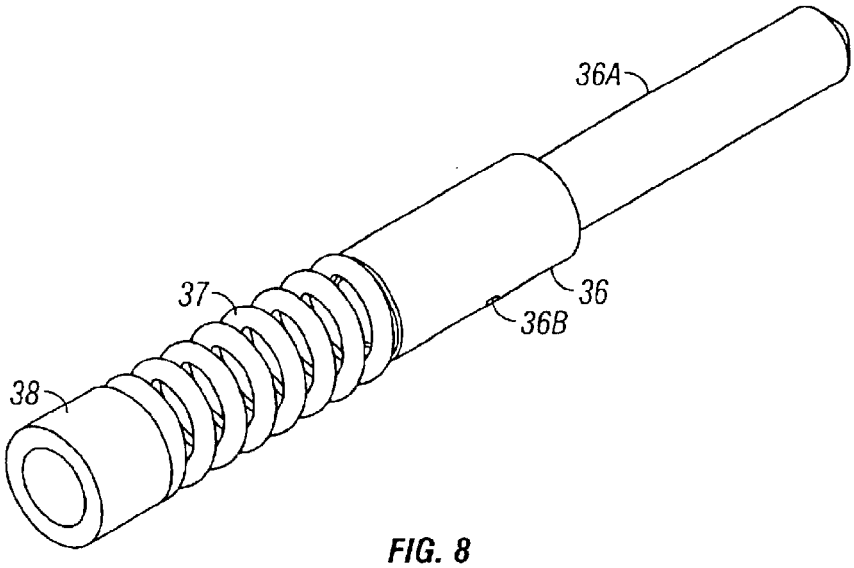
FIG. 8 shows the terminal assembly, with the fiber hidden, of the embodiment of FIGS. 1A and 1B.

FIG. 8 shows the spacer 38, spring 37 and fiber optic terminals 36 as they are located in the connector insert cavities (18A in FIG. 6). The terminals 36 may be a ceramic ferrule 36A which can be either a "LC" or "MU" type, as specified by Telcordia Technologies, Inc., Piscataqway, N.J., and sold by numerous suppliers in the telecommunications industry, both types of which are well known in the art. A metal back-body 36B is pressed onto the rear of the ferrule 36A. The back-body 36B is unique to the particular cavity design. In the present embodiment, the terminals 36 are ones known by industry designation "MU" and, like those of industry designation "LC", have a nominal diameter of 1.25 millimeters. Each optical fiber (not shown) in the optical cable (not shown) can be terminated by one of the terminals 36. The terminal 36 can be coupled to the respective fiber after inserting the fiber (not shown) through one of the springs 37 and spacers 38. Prior to the terminals 36 being installed on to the end of one of the optical fibers in the assembly, the spacer 38 and the spring 37 are slipped over the fiber in the order shown. Epoxy can be used to secure the fiber into the terminal 36. After the epoxy has cured, the end of the terminal 36 opposite the end where the fiber enters the terminal 36 is polished and inspected to the requirements of specification GR-326-CORE, published by Telcordia Technologies, Inc. By using an industry standard LC or MU ferrule substantial volume efficiency is obtained over the use of industry standard 2.5 mm "ST" or "FC" type ferrules, and cost and size efficiencies are realized over the use of 2.0 mm ferrules known by United States military specification MIL-T-29504.

Each one of the fibers terminated in a terminal 36 and having thereon a spring 37 and spacer 38 can then be inserted into a respective opening (18A in FIG. 6) of one of the male connector insert assemblies (such as 18 in FIG. 6). Referring back to FIG. 5, the manner of optical coupling and the function of the various components explained with respect to FIGS. 6 and 7 will now be explained. The optical terminals 36 with spring 37 and spacer 38, having been placed in a respective opening in the male connector insert assembly can then be retained by screwing the retainer plate 32 to the insert assembly 18 using screws 33, or other attachment mechanism (cap screws are shown), as previously explained. Note that the ends of the optical terminals 36 will protrude from the face of the male insert assembly 18. In the present embodiment, the female connector insert assembly is formed by coupling the assembled alignment sleeve retainer bodies (34 in FIG. 7) having the alignment sleeves therein (35 in FIG. 6) to the front face of the connector insert assembly having the fiber terminals 36 protruding out therefrom. The protruding portion of each fiber terminal will then be positioned inside a corresponding one of the alignment sleeves 35 when the assembled bodies 34 are coupled to the insert assembly 18. The exposed face of the assembled bodies 34, also described above as the alignment sleeve holder 39 will then have openings for receiving corresponding protruding ends of fiber terminals from the male connector insert assembly 18. When the insert assemblies are moved together, the protruding optical terminal ends then are inserted into the corresponding alignment sleeves 35, which provide axial alignment of the optical terminal ends on opposite members (10, 11 in FIG. 1) of the connector. When the faces of the male connector insert assembly 18 and the female insert assembly 19 are in complete facial contact with each other, axial coupling between corresponding ends of the fiber terminals 36 on each member of the connector is provided only by the force of each of the springs 37 reacting against the corresponding ones of the spacers 38 backed by the retainer plate 32. Thus, the springs 37 control the axial force of coupling of the opposed optical terminals. Using the springs 37 to control the axial force makes is possible to manufacture the insert assemblies 18 with relatively loose tolerances, particularly as to length along the axis of the connector, while still maintaining proper contact force and alignment of the optical terminals 36 in each member 10, 11 of the connector.

In some embodiments, the cable (not shown) may include both optical fibers and electrical conductors. In such embodiments, some of the optical terminals may be substituted by electrical contacts of any type known in the art. The electrical conductors (not shown) are coupled to corresponding components of the electrical contacts. Corresponding components of the electrical contacts are disposed in corresponding selected openings in each of the male connector insert assembly 18 and female insert assembly 19 such that when the female connector member 11 is coupled to the male connector member 10, electrical contact is established between corresponding electrical contact components (not shown) disposed in each connector member.

A particular advantage offered by a connector made according to the invention is that it is possible to convert a male connector member to a female connector member without uncoupling any of the optical terminals from the optical fibers, and without removing the cable from the connector load transfer assembly. Changing the gender of the connector may be performed as simply as removing the alignment sleeve holder 39 from the female connector insert assembly 19 to convert it to a male connector insert assembly, and changing the female housing (26 in FIG. 1A) to a male housing (25 in FIG. 1A by removing the screws (31 in FIG. 3) and shear pins (29 in FIG. 3), swapping housings from female to male gender. Advantageously, such a cable connector termination as according to the invention may enable use of a cable terminated with a male connector member in a different part of a sensor array in which it is required to couple thereto a female connector member.

Figure 9:
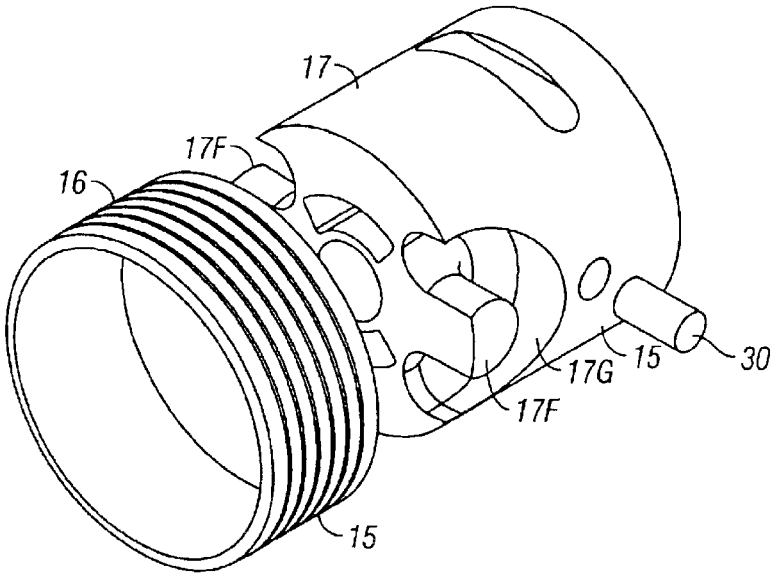
FIG. 9 is an exploded view of a load transfer assembly of the embodiment of FIGS. 1A and 1B.

FIG. 9 shows posts 17F used to couple a cable strength member termination in the cable (not shown in FIG. 9) to the load transfer assembly 15. The posts 17F may be machined while forming the load transfer assembly plug 17. A rigid covering over each post 17F is formed when the hose termination ring 16 is bonded, shrink-fit, swaged, or pressed onto the load transfer assembly plug 17. The cavity 17G formed between the ring 16 and the plug 17 provides a space for capturing a rope eye or the like which makes up the end of the strength member in the cable (not shown). The outer jacket (not shown) of the cable (not shown) may be adhesively bonded or clamped to the hose termination ring so as to form a sealed junction there between. The hose termination ring 16 in the present embodiment is interference fit to the load transfer assembly plug 17, and thus forms a fluid tight seal between the ring 16 and the plug 17. Finally, respective housings, either female or male (26 or 25 in FIG. 1A), are sealably coupled to the outer surface of the respective load transfer assembly plug 17 as previously explained, and thus form a fluid tight seal. When male 25 and female 26 housings are coupled together, they are in sealing contact with each other, such as by elastomeric α-rings or the like, also as previously explained. Thus, the connector of the present embodiment provides a complete fluid tight seal between the termination of one end of the cable coupled to one connector member and the end of the other cable coupled to the end of the corresponding member of the connector.

Embodiments of a cable connector according to the invention may have one or more of the following advantages. First, such connectors may have the optical and/or electrical termination ends thereof repeatedly repaired without the need to break the fluid tight seal or the mechanical strength (load transferring) connection between a cable and a member of the connector. Second, each of the female and male connector members include a large number of substantially identical components. By changing only a few easily replaceable components, a male member may be converted to a female member, and vice versa, without disconnecting the cable from the load transfer or sealing portion of the connector. Thus, in some cases entire sections of cable may be made reversible by changing the gender of the connector without the need to disconnect the load transferring and fluid sealing portions of the connector. Finally, by decoupling and biasing the connection ends from the housing of the respective connector members, it is possible to make some of the components of the connectors to less stringent tolerances, thus reducing cost, while maintaining required mechanical contact alignment and pressure between corresponding ends of optical terminals.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector for joining two cables, comprising:

a load transfer plug adapted to couple to a strength member in each of the cables to be joined;

a connector insert assembly functionally coupled to an inner portion of each load transfer plug;

conductor terminals disposed in corresponding openings of each connector insert assembly, the terminals protruding from a face of the connector insert assembly, the terminals adapted to couple to and terminate conductors in each of the cables;

an alignment sleeve holder coupled to one of the connector insert assemblies, the alignment sleeve holder including alignment sleeves therein for receiving the protruding terminals; and a housing element sealingly coupled to an exterior of each of load transfer plug, the housing elements adapted to sealingly couple to each other, the housing elements adapted to urge the connector insert assemblies into contact with each other and to transfer axial load between the load transfer plugs when the housing elements are coupled to each other, the housing elements having rotational and axial alignment features on corresponding surfaces thereof, the housing elements each adapted to be removed from the load transfer plug without uncoupling the cable from the load transfer plug.

2. The connector of claim 1 wherein the conductors comprise optical fibers.

3. The connector of claim 2 wherein the conductor terminals comprise optical fiber terminals.

4. The connector of claim 3 wherein the terminals are disposed in corresponding openings in respective connector insert assemblies, the terminals urged axially in a direction toward corresponding terminals in the other by a spring having a selected force, the spring reacting against a plate coupled to an outer surface of the connector insert.

5. The connector of claim 4 wherein the selected force is an amount to optimize a contact force between corresponding opposed optical terminals.

6. The connector of claim 1 further comprising at least one conductor storage reel disposed between each of the load transfer plugs and each of the male connector inserts, the storage reel adapted to store a length of the conductor such that ends of the conductor are repeatably repairable without disconnecting the load transfer plug from the end of the cable.

7. The connector of claim 6 wherein the at least one reel is configured to maintain a selected minimum radius of curvature in a conductor spooled thereon.

8. The connector of claim 1 further comprising a spring disposed between each load transfer plug and a corresponding one of the connector inserts to enable axial and lateral movement of the connector insert with respect to the load transfer plug.

9. The connector of claim 1 wherein each housing element is coupled to its respective load transfer plug by a shear pin, the shear pin selected to fail at a selected load amount at most equal to an axial load capacity of the cable.

10. The connector of claim 1 wherein an external jacket of the cable is sealingly coupled to an exterior of each load transfer plug.

11. The connector of claim 10 further comprising a hose termination ring disposed on the outer surface of each load transfer plug, the ring adapted to sealingly receive the jacket thereon.

12. The connector of claim 1 wherein the housing elements comprise corresponding mating threads.

13. The connector of claim 1 wherein each load transfer plug comprises openings for receiving the conductor in the cable, the opening adapted to be sealed with a sealing compound such that an interior of the cable is protected from fluid entry when an uncoupled connector member is exposed to fluid.

14. The connector of claim 1 wherein at least one of the housing elements comprises a groove for receiving an o-ring seal therein to seal against a corresponding sealing surface of the other one of the housing elements.

15. The connector of claim 1 wherein the connector insert assemblies each comprise a standoff adapted to be coupled to the load transfer plug and a potting cup coupled to the standoff, the potting cup adapted to receive a corresponding surface of the connector insert.

16. The connector of claim 1 wherein the alignment sleeve holder comprises index keys adapted to be received in corresponding index openings in each of the connector inserts.

17. The connector of claim 1 wherein the alignment sleeve holder comprises two bodies each having corresponding openings therein for receiving the alignment sleeves, the openings having on an outer portion thereof a smaller diameter to capture the alignment sleeves when the two bodies are mated.

18. The connector of claim 1 wherein the load transfer plugs are substantially identical to each other and the connector insert assemblies are substantially identical to each other such that a male connector element is convertible to a female connector element by coupling the alignment sleeve holder to the inner end of the connector insert assembly and by exchanging a male one of the housing elements for a female one of the housing elements.

19. The connector of claim 1 wherein the conductor terminals comprise ceramic ferrules known by industry designation LC or MU.

20. The connector of claim 1 wherein each load transfer plug comprises an integral pin adapted to receive a rope eye, the rope eye forming a termination of the strength member in the cable.

21. The connector of claim 20 further comprising a hose termination ring coupled to an outer surface of each load transfer plug, the hose termination ring adapted to receive a jacket of the cable and adapted to capture the rope eye when the rope eye is disposed on the integral pin.

22. The connector of claim 1 wherein the connector insert assembly is arranged such that removal of the housing element enables access to the conductors and conductor terminals.

23. A connector for joining two cables, comprising:

a housing element operatively coupled to an end of each cable to be joined;

a connector insert assembly functionally coupled to an inner portion of each housing element using a biasing means, such that a contact force between corresponding connector assemblies when the housing elements are mated is substantially unrelated to a an axial force generated by coupling the housing elements;

conductor terminals disposed in corresponding openings of each connector insert assembly, the terminals protruding from a face of the connector insert assembly, the terminals adapted to couple to and terminate conductors in each of the cables;

an alignment sleeve holder coupled to one of the connector insert assemblies, the alignment sleeve holder including alignment sleeves therein for receiving the protruding terminals; and wherein the housing elements are adapted to sealingly couple to each other, the housing elements are adapted to urge the connector insert assemblies into contact with each other and to transfer axial load between the housing elements when the housing elements are coupled to each other, the housing elements have rotational and axial alignment features on corresponding surfaces thereof, and the housing elements are each adapted to be removed from the corresponding connector insert assembly without uncoupling the cable from the connector insert assembly.

24. The connector of claim 23 wherein the conductors comprise optical fibers.

25. The connector of claim 24 wherein the conductor terminals comprise optical fiber terminals.

26. The connector of claim 25 wherein the terminals are disposed in corresponding openings in respective connector insert assemblies, the terminals urged axially in a direction toward corresponding terminals in the other by a spring having a selected force, the spring reacting against a plate coupled to an outer surface of the connector insert.

27. The connector of claim 26 wherein the selected force is an amount to optimize a contact force between corresponding opposed optical terminals.

28. The connector of claim 23 further comprising at least one conductor storage reel disposed between each of the plugs and each of the male connector inserts, the at least one storage reel adapted to store a length of the conductor such that ends of the conductor are repeatably repairable without disconnecting the plug from the end of the cable.

29. The connector of claim 23 wherein the reel is configured to maintain a selected minimum radius of curvature in conductor spooled thereon.

30. The connector of claim 23 wherein each housing element is sealingly coupled to a respective cable termination by a shear pin, each cable termination adapted to couple to a strength member in one of the cables to be joined, the shear pin selected to fail at a selected load amount at most equal to an axial load capacity of the cable.

31. The connector of claim 30 wherein an external jacket of the cable is sealingly coupled to an exterior of each cable termination.

32. The connector of claim 30 wherein each cable terminator comprises openings for receiving the conductor in the cable, the opening adapted to be sealed with a sealing compound such that an interior of the cable is protected from fluid entry when an uncoupled connector member is exposed to fluid.

33. The connector of claim 30 wherein the cable terminations are substantially identical to each other and the connector insert assemblies are substantially identical to each other such that a male connector element is convertible to a female connector element by coupling the alignment sleeve holder to the inner end of the connector insert assembly and by exchanging a male one of the housing elements for a female one of the housing elements.

34. The connector of claim 30 wherein each cable termination provides for the anchoring and termination of the cable strength member.

35. The connector of claim 23 wherein the housing elements comprise corresponding mating threads.

36. The connector of claim 23 wherein at least one of the housing elements comprises a groove for receiving an o-ring seal therein to seal against a corresponding sealing surface of the other one of the housing elements.

37. The connector of claim 23 wherein the connector insert assemblies each comprise a standoff adapted to be coupled to the load transfer plug and a potting cup coupled to the standoff, the potting cup adapted to receive a corresponding surface of the connector insert.

38. The connector of claim 23 wherein the alignment sleeve holder comprises index keys adapted to be received in corresponding index openings in each of the connector inserts.

39. The connector of claim 23 wherein the alignment sleeve holder comprises two bodies each having corresponding openings therein for receiving the alignment sleeves, the openings having on an outer portion thereof a smaller diameter to capture the alignment sleeves when the two bodies are mated.

40. The connector of claim 23 wherein the conductor terminals comprise optical terminals that use ceramic ferrules known by industry designation LC or MU.

41. The connector of claim 23 wherein the connector insert assembly is arranged such that removal of the housing element enables access to the conductors and conductor terminals without disconnecting the connector insert assembly from the cable.

* * * * *